United States Patent [19]

Nelson

[11] Patent Number: 4,469,770

[45] Date of Patent: Sep. 4, 1984

[54] STYRENE BUTADIENE PLASTICIZER TONER COMPOSITION BLENDS

[75] Inventor: Robert A. Nelson, Fairport, N.Y.

[73] Assignee: Xerox Corporation, Stamford, Conn.

[21] Appl. No.: 453,253

[22] Filed: Dec. 27, 1982

[51] Int. Cl.[3] ..... G03G 9/08; G03G 9/10

[52] U.S. Cl. ..... 430/110; 430/109

[58] Field of Search ..... 430/109, 110

[56] References Cited

U.S. PATENT DOCUMENTS

| | | | |
|---|---|---|---|
| 3,326,848 | 6/1967 | Clemens | 260/41 |
| 3,609,082 | 9/1971 | Moriconi et al. | 430/110 X |
| 3,766,072 | 10/1973 | Metcalfe et al. | |
| 3,933,665 | 1/1976 | Van Engeland et al. | 430/109 |
| 3,965,022 | 6/1976 | Strong et al. | 430/110 X |
| 4,206,064 | 6/1980 | Kiuchi et al. | 430/106 |
| 4,254,205 | 3/1981 | Lu et al. | 430/122 |
| 4,298,672 | 11/1981 | Lu | 430/108 |
| 4,311,779 | 1/1982 | Miyakawa et al. | 430/109 X |
| 4,338,390 | 7/1982 | Lu | 430/106 |

FOREIGN PATENT DOCUMENTS

| | | | |
|---|---|---|---|
| 50-144446 | 11/1975 | Japan | 430/110 |
| 55-153944 | 12/1980 | Japan | 430/109 |
| 476541 | 4/1972 | U.S.S.R. | 430/110 |

*Primary Examiner*—Roland E. Martin, Jr.

*Attorney, Agent, or Firm*—E. O. Palazzo

[57] ABSTRACT

This invention is directed to an improved positively charged toner composition comprised of (1) a styrene butadiene copolymer plasticizer blend, containing from about 92 percent by weight to about 97 percent by weight of styrene butadiene copolymer, and from about 3 percent by weight to about 8 percent by weight of plasticizer, the styrene butadiene copolymer having a weight average molecular weight of from about 45,000 to about 155,000, and a molecular weight distribution of about 7, the copolymer further containing from about 85 percent by weight of styrene to about 93 percent by weight of styrene, and from about 7 percent by weight of butadiene to about 15 percent by weight of butadiene, (2) pigment particles, and (3) a charge enhancing additive.

29 Claims, No Drawings

STYRENE BUTADIENE PLASTICIZER TONER COMPOSITION BLENDS

BACKGROUND

This invention is generally directed to improved toner compositions, and developer compositions containing styrene butadiene copolymer resins. More specifically, the present invention is directed to improved toner compositions comprised of a blend of styrene butadiene copolymer resin particles, and a plasticizer composition. The resulting toner compositions, which have stable electrical properties, desirable glass transition temperatures, desirable melt viscosities, and excellent mechanical properties are suitable for selection in developing images in electrostatic imaging systems, especially those systems wherein the imaging member is charged negatively.

The development of electrostatic latent images, particularly positively charged images, with toner compositions, comprised of a blend of toner resin particles and pigment particles is well known. Generally, in these systems, negatively charged toner particles are selected for the development of the positively charged electrostatic latent images. Recently, however, there has been disclosed positively charged toner compositions containing charge enhancing additives for the purpose of imparting positive charges to the toner resin particles. These positively charged toner compositions are particularly useful for causing the development of negatively charged electrostatic latent images formed on layered organic photoresponsive imaging members. Examples of positively charged toner compositions useful for causing the development of negatively charged electrostatic latent images, are disclosed in U.S. Pat. No. 4,298,672. This patent describes as charge enhancing additives for toner compositions alkyl pyridinium halides, including cetyl pyridinium chloride. Additionally, there is disclosed in U.S. Pat. No. 4,338,390 the use of sulfate and sulfonate compositions, such as stearyl dimethyl phenethyl ammonium para-toluene sulfonate, as charge enhancing additives. In accordance with the disclosure of this Patent, from about 0.1 percent to about 10 percent by weight of the sulfate or sulfonate charge enhancing additive is incorporated into the toner composition, for the purpose of imparting positive charges to the toner resin particles.

Illustrative examples of toner resin particles include numerous known resin compositions, such as styrene butadiene copolymers. For example, there is disclosed in U.S. Pat. No. 3,326,848 a toner composition containing as resin particles a styrene butadiene copolymer, and the use of this composition for developing positively charged latent electrostatic images. Also, there is disclosed in U.S. Pat. No. 3,960,737 a liquid developer composition containing a mixture of a styrene butadiene copolymer and an acrylate. Moreover, in U.S. Pat. No. 3,766,072 there is described a developer composition containing at least two types of particles, one of which is the specific styrene butadiene copolymer resin, designated Pliolite S5D. Additionally, there is disclosed in a copending application the selection of certain specific styrene butadiene resins for incorporation into toner compositions, which compositions can subsequently be used for developing negatively charged electrostatic images. The toner compositions disclosed in this application can contain charge enhancing additives, for the purpose of imparting a positive charge to the styrene butadiene resin particles.

While some of the known styrene butadiene toner compositions may exhibit acceptable fusing latitudes, desirable melt fixing temperatures, and appropriate glass transition temperatures for certain uses, these compositions usually do not simultaneously possess such properties in combination. Also several of the known toner compositions cannot achieve excellent triboelectric admix charging behavior, which is essential for the development of high quality images of excellent resolution. Furthermore, while several of the toner compositions involved may possess acceptable low minimum fix temperatures, their molecular weight may be too low to permit them to be easily formulated into toner compositions, or to provide toner compositions with a sufficient fusing latitude response. Additionally, these compositions usually do not exhibit the appropriate triboelectric charging behavior which would render them suitable for the development of images wherein the photoreceptor is charged negatively. Moreover, these toner compositions may possess the appropriate triboelectric charging characteristics, however, the melt fusing temperature, and fusing latitude for such compositions are not of the desired values causing image deterioration when these toners are used in an imaging system.

Accordingly, there continues to be a need for improved toner compositions and developer compositions, containing styrene butadiene resin particles. There also continues to be a need for toner compositions containing styrene butadiene resins, which have specific parameters associated therewith including a molecular weight of a specific range, a fusing temperature latitude of at least about 60 degrees Fahrenheit, a glass transition temperature within a certain range, and acceptable triboelectric charging characteristics. There also continues to be a need for toner polymer compositions which are capable of improved toner processing response, enabling a significant reduction in the toner unit manufacturing costs, as a result of lower toner micronizability parameters.

SUMMARY OF THE INVENTION

It is an object of the present invention to provide a toner composition which overcomes the above-noted disadvantages.

In a further object of the present invention there is provided a toner composition containing a blend of a styrene butadiene copolymer, and a plasticizer composition.

In an additional object of the present invention there are provided toner compositions of improved melt viscosities, and stable triboelectric charging characteristics.

Another object of the present invention resides in the provision of a developer composition containing a blend of a styrene butadiene resin, a plasticizer composition, carrier particles, and charge enhancing additives.

In a further object of the present invention there are provided toner compositions and developer compositions, useful for developing negatively charged electrostatic images.

In still another object of the present invention there is provided toner compositions and developer compositions with improved micronization behavior, that is the ability of toner compositions to be attrited to a specific volume median size at rapid processing speeds.

These and other objects of the present invention are accomplished by the provision of an improved positively charged dry toner composition comprised of a blend of styrene butadiene resin particles, and a plasticizer composition, pigment or colorant particles, and a charge enhancing additive. More specifically, the present invention is directed to an improved positively charged toner composition comprised of from about 40 percent by weight to about 94.5 percent by weight of a blend of styrene butadiene copolymer resin particles, and a plasticizer composition, containing from about 92 percent by weight to about 97 percent by weight of the styrene butadiene copolymer, and from about 3 percent by weight to about 8 percent by weight of the plasticizer composition, wherein the styrene butadiene copolymer has a weight average molecular weight of from about 45,000 to about 155,000, and a number average molecular weight of from about 7,000 to about 25,000, which copolymer contains from about 85 percent by weight of styrene to about 93 percent by weight of styrene, and from about 15 percent by weight of butadiene to about 7 percent by weight of butadiene, (2) a charge enhancing additive present in an amount of from about 0.50 percent by weight to about 5 percent by weight, and (3) colorant or pigment particles, present in an amount of from about 5 weight percent to about 60 weight percent. In one preferred embodiment, the toner particles of the present invention are comprised of 93 percent by weight of the styrene butadiene copolymer/-plasticizer blend, 1 percent by weight of a charge enhancing additive, and 6 percent by weight of carbon black.

The improved toner compositions of the present invention have for example, stable triboelectric properties. Thus, for example, the toner composition of the present invention possesses a triboelectric value of from about 10 microcoulombs per gram to about 40 microcoulombs per gram, and preferably has a triboelectric value of about 30 microcoulombs per gram. Additionally, the improved toner compositions of the present invention have a melt viscosity, as measured on a Melt Flow Index Device ranging from about 15 to about 80, at 150 degrees Centigrade with a 2.16 kilogram weight, and a glass transition temperature ranging from about 55 degrees Centigrade to about 62 degrees Centigrade. In one preferred embodiment of the present invention, the improved toner composition has a melt index of 14, and a glass transition temperature of about 58 degrees Centigrade.

The minimum fix temperature of the toner composition of the present invention, that is the temperature at which the toner is sufficiently melted, coalesced, and attached to a substrate such as paper, so as to withstand conventional handling, blocking, smudging and/or loss of information, as measured, for example, in a test fixture containing a silicone soft roll fuser set up to deliver a 0.2 inch nip, with a 10 millisecond dwell time, ranges from about 290 degrees Fahrenheit to about 320 degrees Fahrenheit, and preferably is about 310 degrees Fahrenheit or, about 30 degrees Fahrenheit less than many known toner formulations.

The fusing temperature latitude for the toner compositions of the present invention, which latitude is measured by the difference in temperature for the toner composition between the hot offset temperature, and the minimum fuse temperature, with the hot offset temperature being the temperature at which the toner image splits internally with some of the toner remaining on a silicone fuser roll, generally ranges from about 60 degrees Fahrenheit to greater than about 120 degrees Fahrenheit, with the preferred temperature being equal to or greater than 100 degrees Fahrenheit. Additionally, the blocking temperature of the toner composition of the present invention ranges from about 115 degrees Fahrenheit to about 130 degrees Fahrenheit.

Of critical importance to the toner composition of the present invention is the blend of styrene butadiene copolymer resin and plasticizer composition. The plasticizer composition, which can be present in an amount of from about 3 percent by weight to about 8 percent by weight attaches to the toner resin particles during processing by emulsion polymerization with the hydrophobic portion of the composition being incorporated into the toner resin particles, while the hydrophilic portion of the composition is exposed and extends away from the toner resin particles. The styrene butadiene plasticizer blend, which is available from Goodyear Tire & Rubber Company, is prepared by an emulsion polymerization process, wherein certain styrene butadiene copolymer resin particles are mixed with a surfactant, followed by the addition of a coagulating composition, such as sulfuric acid, which causes the previously separate resin particles to agglomerate. Additionally, during the coagulation step, the salt portion of the surfactant used is converted to for example, a carboxylic acid, which conversion causes the surfactant to function as a plasticizer composition. This composition which is soluble in the styrene butadiene copolymer, provides for resultant toner particles which have improved flowability characteristics and further allows the toner particles to coalesce, providing toner compositions with many of the desirable properties disclosed herein including lower minimum fix temperatures. Moreover, the plasticizer composition functions as a triboelectric charge controlling material, wherein the positive triboelectric charge on the toner particles is reduced.

Additionally, toner particles containing the styrene butadiene copolymer plasticizer composition blend of the present invention possess improved micronization characteristics, which allows the toner particles to be prepared at reduced processing costs. Generally, micronization behavior can be described as the ability of a toner composition to be attrited to a specific volume median size under a normal range of processing parameters including conventional grind pressures and feed pressures. The more rapid a material can be fed through the processing apparatus, the lower the cost for producing such a material.

As disclosed herein, prior to the formation of the styrene butadiene plasticizer composition blend, a coagulation agent is added thereto for the purpose of neutralizing the salt portion of the surfactant present, to a free acid material. Accordingly, the coagulating agent is selected from materials that are capable of donating protons, including for example, sulfuric acid, hydrochloric acid, acetic acid, and the like, with sulfuric acid being preferred.

Illustrative examples of surfactant materials useful for preparing the initial resin blend, which surfactant upon being converted from the salt embodiment to an acid, function as plasticizers, as indicated herein, include Dressinate, 731, available from Hercules Chemical Company, and the like. This material, D 731 is believed to be the soldium salt of a carboxylic acid functionality, prepared from the dispropriation of wood rosin acid.

While it is not desired to be limited to specific process parameters in one embodiment it is believed that the styrene butadiene copolymer plasticizer composition blend suitable for selection in the toner compositions of the present invention, which blend is available from Goodyear Tire & Rubber Company, may be prepared by a polymerization process, wherein there is added to a reaction vessel water and a soluble surfactant composition. Subsequently, there is added to the reaction vessel an initiator, which is also soluble in water, such as potassium persulfate. Styrene monomer containing a chain modifier, such as dodecyl mercaptan is then added thereto, followed by pressurizing the reactor with the proper amount of buatdiene gas, which butadiene can also be dissolved in the styrene when the mixture is added. The reactor mixture is stirred and the temperature raised to promote polymerization. Upon achieving the desired conversion, the reaction is terminated, and the reaction mixture is cooled. To the resulting emulsion of very small solid particles is added an excess amount of sulfuric acid, which causes an agglomeration of the small particles resulting in the formation of larger "crumbs". The crumbs are washed with water until neutral, then filtered and dried. The resulting material is a blend of styrene butadiene copolymer plasticizer composition. The addition of a coagulating material, such as sulfuric acid, converts the salt portion of the surfactant to a free acid which results in converting the surfactant to a plasticizing material. Toner compositions containing the styrene butadiene plasticizing composition blend have improved desirable characteristics as indicated herein, in comparison to identical but nonplasticized styrene butadiene copolymer systems.

In preparing the toner compositions, there is added to the styrene butadiene copolymer plasticizer blend various known suitable dyes or colorants, including various types of carbon blacks, magnetites, such as Mapico black, a mixture of iron oxides, Nigrosine dye, aniline blue, chrome yellow, ultramarine blue, duPont oil red, phthalocyanine blue, and mixtures thereof, with the preferred material being carbon black. The colorant should be present in the toner in sufficient quantity to render it highly colored so that it will form a visible image on the imaging member. For example, where conventional xerographic copies of documents are desired the toner may comprise a black pigment such as carbon black. Also a black dye such as commercially available from National Aniline Products Inc. can be employed. Preferably the colorant is employed in amounts of from about 5 percent by weight to about 60 percent by weight based on the total weight of toner particles.

Illustrative examples of charge enhancing additives selected for the toner compositions of the present invention include nigrosine, alkyl pyridinium compounds of the following formula:

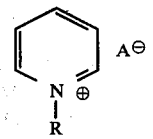

wherein R is an aliphatic group such as methyl, ethyl, propyl, butyl, hexyl, octyl, nonyl and the like, and A is an anion such as chloride, bromide, fluoride, sulfate, sulfonate, phosphate, borate, sulfate and sulfonate compositions as described in U.S. Pat. No. 4,338,390, the disclosure of which is totally incorporated herein by reference, including stearyl dimethyl phenethyl ammonium para-toluene sulfonate, and the like. The preferred additive is cetyl pyridinium chloride.

The charge enhancing additive is present in an amount of from about 0.50 percent by weight to about 5 percent by weight, and preferably the additive is present in an amount of from about 1.0 percent to about 3 percent by weight.

Several methods may be selected for preparing the toner composition of the present invention, including, for example, melt blending the styrene butadiene copolymer resin plasticizer blend, pigment particles and charge enhancing additives, followed by mechanical attrition. Other methods include those well-known in the art such as spray drying, and melt dispersion processes. For example, a solvent dispersion of the resin blend of styrene butadiene copolymer plasticizer composition, pigment particles and charge enhancing additive, are spray dryed under controlled conditions resulting in the desired toner composition. A toner composition prepared in this manner is positively charged in relation to the carrier particles which are present when a developer composition is formulated.

Any suitable carrier material can be selected for mixing with the toner composition of the present invention when a developer composition is desired, as long as such particles are capable of triboelectrically obtaining a charge of opposite polarity to that of the toner particles. In one embodiment in the present invention that would be a negative polarity to that of the toner particles which are positively charged so that the toner particles will adhere to and surround the carrier particles. Accordingly, the carriers which can be selected so that the toner particles acquire a charge of positive polarity, include inorganic materials, and organic materials, including for example, glass, steel, nickel, iron ferrite, silicon dioxide, and the like. Coated carriers that may be used include the above-mentioned carriers coated for example with organic materials such as fluorinated polymers including polyvinylidene fluoride. Many of the carriers that can be used are described in U.S. Pat. Nos. 2,618,441, 3,533,835 and 3,526,533. Also nickel berry carriers as described in U.S. Pat. Nos. 3,847,604 and 3,767,598 can be employed, these carriers being nodular beads of nickel characterized by surfaces of recurring recesses and protrusions, thus providing particles with a relatively large external area. The diameter of the coated carrier particle is from about 50 to about 1,000 microns thus allowing the carrier to possess sufficient density and inertia to avoid adherence to the electrostatic images during the development process.

The carrier may be mixed with the toner composition in any suitable combination, however, best results are obtained when about 1 part per toner is used and about 10 to about 200 parts per weight of carrier.

Developers of the present invention may be selected for the development of electrostatic latent images on various suitable electrostatic surfaces capable of retaining charge, including conventional photoconductors, however, the toner compositions of the present invention are best utilized in systems wherein a negative charge resides on the imaging member, and this usually occurs with organic photoceptors. Illustrative examples of such photoreceptors include 4-dimethylamino benzylidene, benzhydrazide, 2-benzylideneamino-carbazole, polyvinylcarbazole substituted materials, (2-nitrobenzylidene)-p-amino aniline, 2,4-diphenylquinazoline, 1,2,4-triazine, 1,5-diphenyl-3-methyl pyrazoline, 2-(4'-dimethyl amino phenyl)-benzoxazole, 3-amino carbazole, polyvinyl carbazole-trinitrofluorenone charge transfer complexes, phthalocyanines, and mixtures thereof.

The developer compositions of the present invention are particularly useful in electrostatographic imaging systems having incorporated therein layered photoresponsive imaging devices comprised of a substrate, a photogenerating layer, and a transport layer, as described in U.S. Pat. No. 4,265,998, the disclosure of which is totally incorporated herein by reference. Examples of photogenerating layers include metal phthalocyanines, metal free phthalocyanines, vanadyl phthalocyaine, and trigonal selenium. Illustrative examples of charge transport layers include the various diamines as disclosed in the U.S. Pat. No. 4,265,998 patent.

With regard to the blocking temperature of the toner compositions of the present invention, such a temperature is defined as the point where caking or agglomeration occurs within a 24 hour period. The blocking temperature, a well known rheological property, is directly related to the glass transition temperature. For example, it has been experimentally observed, reference the viscosity of polymers and their concentrated solution by G. C. Berry and T. G. Fox in *Advances in Polymer Science,* Vol. 5, pages 261–357 (1968) that for a given glass transition temperature, polymer families exhibiting the lowest polarity exhibit the lowest viscosity at elevated temperatures and thus might be expected to possess the lowest minimum fix temperature. By this criteria, the styrene butadiene copolymers of the present invention are excellent resins for toners because of their low polarity relative to other resins such as the styrene methacrylate family.

The following examples are being supplied to further define various embodiments of the present invention, it being noted that these examples are intended to illustrate and not limit the scope of the present invention. Parts and percentages are by weight unless otherwise indicated. Also, the molecular weights were determined by light scattering analysis, the blocking temperatures by ASTM procedures, open cup blocking test, and glass transition temperatures, by differential scanning calorimetry.

EXAMPLE I

A toner composition was prepared by melt blending followed by mechanical attrition, which composition comprised a styrene butadiene copolymer resin plasticizer blend, available from Goodyear Tire & Rubber Company, and prepared from the sulfuric acid coagulation of an emulsion latex, which contains 95 percent by weight of a styrene butadiene copolymer, comprised of 91 percent by weight of styrene, and 9 percent by weight of butadiene, and 5 percent by weight of the surfactant Dressinate, D-731, commercially available from Hercules Chemical Corporation, 6 percent of Regal 330 carbon black, and 2 percent by weight of the charge enhancing additive cetylpyridinium chloride.

The styrene butadiene resin had a weight average molecular weight of 99,000, a number average molecular weight of 14,000, a minimum fix temperature of 310 degree Fahrenheit, a hot offset temperature of 410 degrees Fahrenheit, a fusing temperature latitude of 100 degrees Fahrenheit, and a blocking temperature of 125 degrees Fahrenheit. The fixing temperature of the styrene butadiene copolymer resin was measured in a test fixture containing a silicone soft roll fuser, set up to deliver a 0.2 inch nip with a 10 millisecond dwell time.

A developer composition was then prepared by mixing three parts by weight of the above prepared toner composition, with 97 parts by weight of carrier particles consisting of a steel core coated with 0.15 percent by weight of a polyvinylidene fluoride resin.

EXAMPLE II

There was prepared a toner and developer composition by repeating the procedure of Example 1 with the exception that the styrene butadiene copolymer resin selected had a weight average molecular weight of 155,000, a number average molecular weight of 22,000, a minimum fix temperature of 320 degrees Fahrenheit, a hot offset temperature of greater than 440 degrees Fahrenheit, a fusing temperature latitude of 120 degrees Fahrenheit, and a blocking temperature of 125 degrees Fahrenheit.

A developer composition was then prepared by mixing three parts by weight of the toner composition of this Example with 97 parts by weight of carrier particles consisting of a steel core coated with a polyvinylidene fluoride resin.

EXAMPLE III

The toner composition prepared in accordance with Example I was subjected to a flash fusing process test, and as a result it was determined that the toner composition had a minimum fix energy that is an acceptable fix to paper of 5.5 Joules/inches$^2$ at the paper surface, and required 5.5 Joules/inches$^2$ to deliver a 1.2 solid area density out for a 1.2 solid area density in.

The flash fusing test was accomplished by placing the toner composition in a cavity containing a Xenon flash lamp. The Xenon flash lamp was activated producing energy of 5.5 Joules/inches at the paper surface, which was absorbed by the toner composition causing it to melt.

EXAMPLE IV

The styrene/butadiene copolymer resin plasticizer blend of Example I, was subjected to a repetitive solvent/non-solvent precipitation technique for the purpose of removing the plasticizer therefrom. This was accomplished by dissolving the styrene butadiene copolymer plasticizer blend of Example I in methylene chloride, followed by adding methanol for the purpose of causing the formation of a styrene butadiene copolymer resin precipitate. The plasticizer remains in solution.

The precipitated styrene butadiene copolymer resin was subjected to infrared analysis which confirmed that the absorption band due to the carboxylic acid component of the plasticizer was no longer present.

The resulting styrene butadiene copolymer resin had a melt index of 2.9, at 150 degrees Centigrade, 2.160 kilogram weight, and a melt index of 13.4, at 150 degrees Centigrade with a 5 kilogram weight. The glass transition temperature of this resin was 71 degrees Centigrade.

In comparison, the styrene butadiene copolymer plasticizer blend of Example I under identical measuring conditions, had a melt index of 14.3 and 49.4 respectively, and a glass transition temperature of 59 degrees Centigrade.

The styrene butadiene copolymer resin without plasticizer as prepared in this example, was then selected for preparing a toner composition by repeating the procedure of Example I. The resulting toner composition which contained 6 percent by weight of 330 Regal carbon black, and 2 percent by weight of cetyl pyridinium chloride, was the subjected to a flash fusing process test in accordance with Example III. The toner composition of this Example had a minimum fix energy of 6.3 Joules/inches$^2$, at the paper surface, and required 6.75 Joules/inches$^2$ to deliver a 1.2 solid area density out, for a 1.2 solid area density in. Thus, significantly more energy, 6.3 Joules/inches$^2$ is needed for fixing as compared to 5.5 Joules/inches$^2$ for the toner composition of Example III.

EXAMPLE V

A toner composition was prepared by repeating the procedure of Example I, and subsequently subjecting this composition to micronization tests with a micronizer, for the purpose of determining the micronization behavior characteristics of the toner composition in accordance with the following equation:

$$\text{Volume medium toner size} = 5.4 + K_2\left(\frac{\text{feedrate, lbs/hr}}{\text{Grind Pressure absolute}^{1.5}}\right)$$

The value of $K_2$ for the toner composition of Example I was 2463.

A toner composition containing the same ingredients with the exception that the styrene butadiene resin copolymer of Example IV was selected, which copolymer did not contain a plasticizer, had a $K_2$ value of 3529 or 30 percent higher than the $K_2$ value for the toner composition with plasticizer.

A smaller value of $K_2$ represents a toner composition which can be more economically prepared.

EXAMPLE VI

In order to demonstrate the triboelectric charge control characteristics exerted by the plasticizer composition, the triboelectric charge on the toner composition of Example I was compared with the triboelectric charge on the toner composition of Example IV, subsequent to mixing in each instance with a carrier comprised of a steel core coated with a polyvinylidene fluoride resin. The triboelectric charges of the two toner compositions was measured in a Faraday cage, using an 8 ounce glass jar, rolled for 5 hours at 90 feet per minute, at a 3 percent toner concentration.

The toner of Example I had a positive toner triboelectric charge of 27.7 microcoulombs per gram and a tribo product (tribo charge multiplied by toner concentration) of 78.4 microcoulombs per gram, while the toner composition of Example IV containing the styrene butadiene resin copolymer and no plasticizer, had a positive toner triboelectric charge of 32.6 microcoulombs per gram and a tribo product of 91.3 microcoulombs per gram.

EXAMPLE VII

A known toner composition comprised of 90 percent by weight of a styrene n-butylmethacrylate copolymer, weight average molecular weight of 65,000, and number average molecular weight of 29,500, containing 58 percent by weight of styrene, 42 percent by weight of n-butylmethacrylate, and 10 percent by weight of carbon black was subjected to the silicone roll fusing test of Example I. The resulting toner composition under identical conditions had a minimum fix temperature of 340 degrees Fahrenheit, a hot offset temperature of 395 degrees Fahrenheit, and a fusing temperature latitude of only 55 degrees Fahrenheit.

EXAMPLE VIII

A known toner composition was prepared by melt blending followed by mechanical attrition, which toner composition contained 92 percent by weight of a styrene n-butylmethacrylate copolymer, weight average molecular weight of 65,000, and number average molecular weight of 29,500, containing 58 percent by weight of styrene, and 42 percent by weight of n-butylmethacrylate, 6 percent by weight of Regal 330 carbon black, and 2 percent by weight of cetyl pyridinium chloride. The resulting toner composition was then subjected to similar fusing tests as accomplished for the toner of Example I. The toner containing the styrene n-butylmethacrylate copolymer had a minimum fix temperatures of 320 degrees Fahrenheit, a hot offset temperature of 390 degrees Fahrenheit, and a fusing temperature latitude of 70 degrees Fahrenheit.

EXAMPLE IX

The developer composition as prepared in Examples I and II, were selected for the development of latent electrostatic images formed on an imaging member comprised of polyvinylcarbazole charged positively, which imaging member was incorporated into a xerographic fixture. Excellent quality prints of high resolution were obtained.

With regard to each of the toner materials being evaluated for melt fusing temperature, hot offset temperature, temperature latitude, the following specific test conditions were adhered to:

Image test targets consisting of both solid areas and lines were prepared using the toner compositions being evaluated. The toner images which are contained on standard xerographic grade paper were then passed thru a roll fusing fixture device containing two silicone soft fuser rolls, which has been set to a particular nip and dwell, that is a nip of 0.200 inch with a dwell of 10 milliseconds. The set temperature of the fuser rolls was varied in 5.0 degree Fahrenheit increments from a temperature below the expected minimum fix temperature to a temperature above the minimum fix temperature, 280 to 340 degrees Fahrenheit. The fixed images were then evaluated using a Taber Abrasor by recording the number of cycles required to obtain a 20 percent reduction in optical density. By acceptable fix, reference Example III, is meant that at 8 cycles there was not a reduction in optical density of greater than 20 percent, as measured with a densitometer.

To determine the hot offset temperature for each of the above indicated toner compositions, the fuser roll fixture was first brought to an equilibrium temperature, and process condition by passing thru the fixture a minimum of 2,000 copies at which time the hot offset behavior was observed as a function of fuser roll temperature, which was varied in 5 degree Fahrenheit increments. Hot offset behavior is measured by observing the print back onto a blank sheet of paper passed thru the fuser after an imaged copy has been passed thru. The fuser set temperature at which print back is seen is identified as the toner hot offset temperature. The effective fusing latitude of the toner is then defined as the difference in temperature between the hot offset temperature and the melt fusing temperature.

Other modifications of the present invention may occur to those skilled in the art upon a reading of the present disclosure. These are intended to be included within the scope of the present invention.

I claim:

1. An improved positively charged toner composition consisting essentially of (1) a styrene butadiene copolymer plasticizer blend, wherein during emulsion polymerization the plasticizer prior to acid coagulation functions as a surfactant, and hydrophobic portion of the surfactant being incorporated into the toner resin and the hydrophilic portion of the surfactant extending away from said toner particles, containing from about 92 percent by weight to about 97 percent by weight of styrene butadiene copolymer, and from about 3 percent by weight to about 8 percent by weight of plasticizer, the styrene butadiene copolymer having a weight average molecular weight of from about 45,000 to about 155,000, and a number average molecular weight of from about 7,000 to about 25,000, the copolymer containing from about 85 percent by weight of styrene to about 93 percent by weight of styrene, and from about 7 percent by weight of butadiene to about 15 percent by weight of butadiene, (2) pigment particles, and (3) a charge enhancing additive.

2. A toner composition in accordance with claim 1 wherein the styrene butadiene copolymer resin plasticizer composition blend is present in an amount of from about 40 percent by weight to about 94.50 percent by weight, the pigment particles are present in an amount of from about 5 percent by weight to about 60 percent by weight, and the charge enhancing additive is present in an amount of from about 0.50 percent by weight to about 5 percent by weight.

3. A toner composition in accordance with claim 1 wherein the resin blend is present in an amount of 93 percent by weight, the pigment particles are present in an amount of 6 percent by weight, and the charge enhancing additive is present in an amount of 1 percent by weight.

4. A toner composition in accordance with claim 1 wherein the resin blend consists of 95 percent by weight of the styrene butadiene copolymer, and 5 percent by weight of the plasticizer.

5. A toner composition in accordance with claim 1 wherein the plasticizer is derived from a surfactant comprised of the sodium salt of a carboxylic acid prepared by the disproportionation of wood rosins, by treating this surfactant with a coagulating composition.

6. A toner composition in accordance with claim 5 wherein the coagulating composition is sulfuric acid.

7. A toner composition in accordance with claim 1 wherein the pigment particles are carbon black, or magnetites.

8. A toner composition in accordance with claim 1, wherein the charge enhancing additive is an alkyl pyridinium halide, an aromatic sulfonate, or aromatic sulfate.

9. A toner composition in accordance with claim 8, wherein the alkyl pyridinium halide is cetyl pyridinium chloride.

10. A toner composition in accordance with claim 8 wherein the sulfonate charge enhancing additive is stearyl dimethyl phenethyl ammonium para-toluene sulfonate.

11. A toner composition in accordance with claim 1 wherein the toner composition has a triboelectric charge of from about 10 microcoulombs per gram to about 40 microcoulombs per gram.

12. An improved developer composition consisting essentially of the toner particles of claim 1, and carrier particles.

13. An improved developer composition in accordance with claim 12, wherein the carrier particles consist of a steel core coated with a polyvinylidene fluoride resin.

14. A method for developing images in a xerographic imaging system, consisting essentially of charging the imaging member negatively, contacting the negatively charged image with the improved developer composition of claim 13, transferring the developed image to a suitable substrate, and optionally permanently affixing the image thereto.

15. A method of imaging in accordance with claim 14 wherein the copolymer plasticizer blend consists of 95 percent by weight of the styrene butadiene copolymer, and 5 percent by weight of the plasticizer.

16. A method of imaging in accordance with claim 14 wherein the plasticizer is derived from a surfactant comprised of the sodium salt of a carboxylic acid functionally prepared from the disproportionation of wood rosin, by reacting the surfactant with a coagulating composition.

17. A method of imaging in accordance with claim 14 wherein the charge enhancing additive is an alkyl pyridium halide, or organic sulfonate composition.

18. A method of imaging in accordance with claim 14 wherein the imaging member is comprised of a substrate, a photogenerating layer, and a charge transport layer.

19. A method of imaging in accordance with claim 14 wherein the imaging member contains a photogenerating layer of trigonal selenium, metal phthalocyanines, metal free phthalocyanines, or vanadyl phthalocyanine.

20. A toner composition in accordance with claim 1, wherein the composition has a glass transition temperature of from about 55 degrees Centigrade to about 62 degrees Centigrade, a fusing temperature latitude of from about 100 degrees Centigrade to about 120 degrees Centigrade, a blocking temperature of from about 115 degrees Centigrade to about 130 degrees Centigrade, and a melt viscosity of from about 5 to about 80.

21. An improved positively charged toner composition consisting essentially of (1) a styrene butadiene copolymer plasticizer blend, containing from about 92 percent by weight to about 97 percent by weight of a styrene butadiene copolymer, and from about 3 percent by weight to about 8 percent by weight of a plasticizer, the styrene butadiene copolymer having a weight average molecular weight of from about 45,000 to about 155,000, and a number average molecular weight of from about 7,000 to about 25,000, the copolymer containing from about 85 percent by weight of styrene to about 93 percent by weight of styrene, and from about 7 percent by weight of butadiene to about 15 percent by weight of butadiene, and wherein the plasticizer is derived from a surfactant comprised of the sodium salt of a carboxylic acid prepared by the disproportionation of wood rosins by reacting the surfactant with a sulfuric acid coagulating composition; (2) pigment particles; and (3) a charge enhancing additive in an amount of from about 0.50 percent by weight to about 5 percent by weight.

22. An improved toner composition in accordance with claim 21 wherein the plasticizer composition is attached to the toner resin particles during processing by emulsion polymerization.

23. An improved toner composition in accordance with claim 21 wherein the resulting toner particles possess improved flowability characteristics and desirable minimum fix temperatures.

24. An improved toner composition in accordance with claim 21 wherein the fusing temperature latitude of the toner composition ranges from about 60° F. to greater than about 120° F.

25. An improved toner composition in accordance with claim 21 wherein the toner composition possesses a blocking temperature of from about 115° F. to about 130° F.

26. An improved toner composition in accordance with claim 21 wherein the coagulating agent is hydrochloric acid, or acetic acid.

27. An improved developer composition comprised of the toner particles of claim 21 and carrier particles.

28. An improved developer composition in accordance with claim 27 wherein the carrier particles consist of a steel core coated with a polyvinylidenefluoride resin.

29. An improved toner composition in accordance with claim 21 wherein the melt viscosity of said toner particles is from about 5 to about 80.

* * * * *